US006595562B1

(12) United States Patent
Wood

(10) Patent No.: US 6,595,562 B1
(45) Date of Patent: Jul. 22, 2003

(54) LABEL HOLDER AND CLOSURE DEVICE

(76) Inventor: Lynn F. Wood, 207 Page St. East, St. Paul, MN (US) 55107

( * ) Notice: Subject to any disclaimer, the term of this patent is extended or adjusted under 35 U.S.C. 154(b) by 0 days.

(21) Appl. No.: 09/948,412

(22) Filed: Sep. 7, 2001

(51) Int. Cl.[7] ..... B65D 27/30
(52) U.S. Cl. ..... 292/307 A
(58) Field of Search ..... 24/30.5 R, 30.5 T, 24/18, 129 R, 130, 129 B; 292/253, DIG. 16, 307 A, 315, 325, 326; 40/110 R

(56) References Cited

U.S. PATENT DOCUMENTS 1,945,677 A * 2/1934 Brooks ..... 292/325
2,983,539 A * 5/1961 Norin ..... 292/308
3,309,745 A * 3/1967 Gintz ..... 24/129
4,001,957 A * 1/1977 Castro ..... 40/10 R
4,106,123 A * 8/1978 Freedman ..... 24/129 R
5,205,687 A * 4/1993 Boyland ..... 410/98
5,625,925 A * 5/1997 Richards ..... 24/129 B

FOREIGN PATENT DOCUMENTS

FR 2232472 * 1/1975 ..... B61D/7/10

* cited by examiner

*Primary Examiner*—Gary Estremsky
(74) *Attorney, Agent, or Firm*—Hugh D. Jaeger

(57) ABSTRACT

A label holder and closure device which secures the draw tape of draw tape-type bags without the need for tying or knotting the draw tape. The label holder and closure device remains on the draw tape during use and will not easily become disassociated with its bag. There is also a provision for two sizes of labels to be easily slid into the label holder and closure device where they are frictionally engaged until intentionally removed. The label holder and closure device may also be used with drawstring-type bags and the like.

27 Claims, 5 Drawing Sheets

LABEL HOLDER AND CLOSURE DEVICE

CROSS REFERENCES TO CO-PENDING APPLICATIONS

None.

BACKGROUND OF THE INVENTION

1. Field of the Invention

The present invention is for a label holder and closure device commonly used by the Post Office for labeling and securing plastic draw tape mail bags. The labels typically contain a bar code and routing information which are slid into and frictionally engage the label holder. The label holder and closure device secures the cinched up draw tape bags by routing the draw tape through several slots without the need for tying or knotting the draw tape. The label holder and closure device can also be used with drawstring-type bags and the like.

2. Description of the Prior Art

The present label holders and closure devices commonly fall off of the draw tape of mail bags during normal use. Since the label holder doubles as a closure device, the usefulness of the draw tape bag is greatly lessened when the label holder and closure device is separated from the draw tape bag. Existing label holders of this type are made of molded plastic and have a top slot which begins at an edge of the label holder and terminates at a circular aperture into which a draw tape is lodged after passing through the top slot. The problem with these existing label holders is that the width of the top slot is too great. As a result, the draw tape frequently passes back through the top slot, whereupon the label holder falls off and becomes disassociated with the draw tape bag.

SUMMARY OF THE INVENTION

The general purpose of the present invention is a label holder and closure device.

According to one embodiment of the present invention, there is provided a label holder and closure device for use with draw tape bags, including a top slot which is molded narrower than the draw tape it secures. There is also provided a label holder with a narrow top slot which is attain by controlled deformations with or without the application of heat. There is yet another provision which incorporates a thin plastic, solid webbing which extends across the top slot and is slit either during the manufacturing process or just prior to use. There is an additional provision for installing a staple across the top slot which also secures the label holder and closure device to the draw tape. A label holder and closure device which secures the draw tape of draw tape-type bags without the need for tying or knotting the draw tape. The label holder and closure device remains on the draw tape during use and will not easily become disassociated with its bag. It is to be understood that the present invention may be slightly modified for use with drawstring-type bags and the like. There is also a provision for two sizes of labels to be easily slid into the label holder and closure device where they are frictionally engaged until intentionally removed.

One significant aspect and feature of the present invention is a top slot which is molded narrower than the thickness of the draw tape or drawstring used.

Another significant aspect and feature of the present invention is a set of controlled deformations at each side of the top slot which is narrower than the thickness of the used draw tape or drawstring.

Still another significant aspect and feature of the present invention is a thin solid webbing which extends across the top slot which is slit either during the manufacturing process or just prior to use.

Yet another significant aspect and feature of the present invention is a staple which is installed after the draw tape or drawstring is inserted into the top slot.

A further significant aspect and feature of the present invention is the ability to keep direct contact with the draw tape or drawstring when the secured bag is opened and closed repeatedly.

A still further significant aspect and feature of the present invention is provision for two different sized labels.

Having thus described embodiments of the present invention, it is the principal object of the present invention to provide a label holder and closure device which will not become disassociated with its intended draw tape or drawstring.

One object of the present invention is to provide a top slot which is molded narrower than the thickness of the draw tape or drawstring it secures.

Another object of the present invention is to provide a top slot with controlled deformations which creates a top slot narrower than the thickness of the draw tape or drawstring it secures.

Yet another object of the present invention is to provide a thin solid webbing across the top slot which is cut either during the manufacturing process or just prior to use and is narrower than the thickness of the draw tape or drawstring it secures.

Still another object of the present invention is to provide a staple installed across the top slot once the draw tape or drawstring is slid into the top slot, preventing removal.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
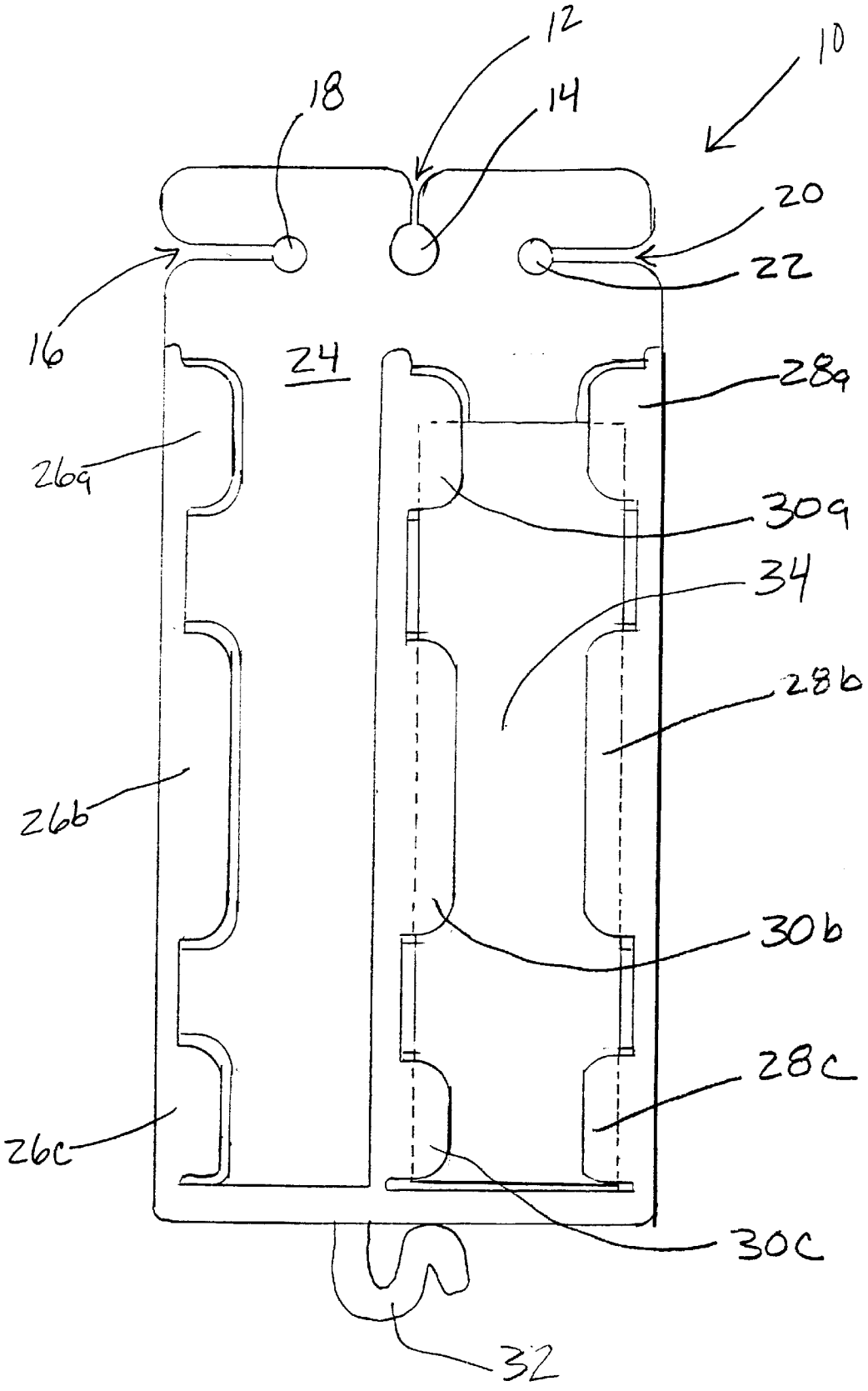
FIG. 1 illustrates a front view of a label holder and closure device with a molded narrower top slot, the present invention.
Figure 5:
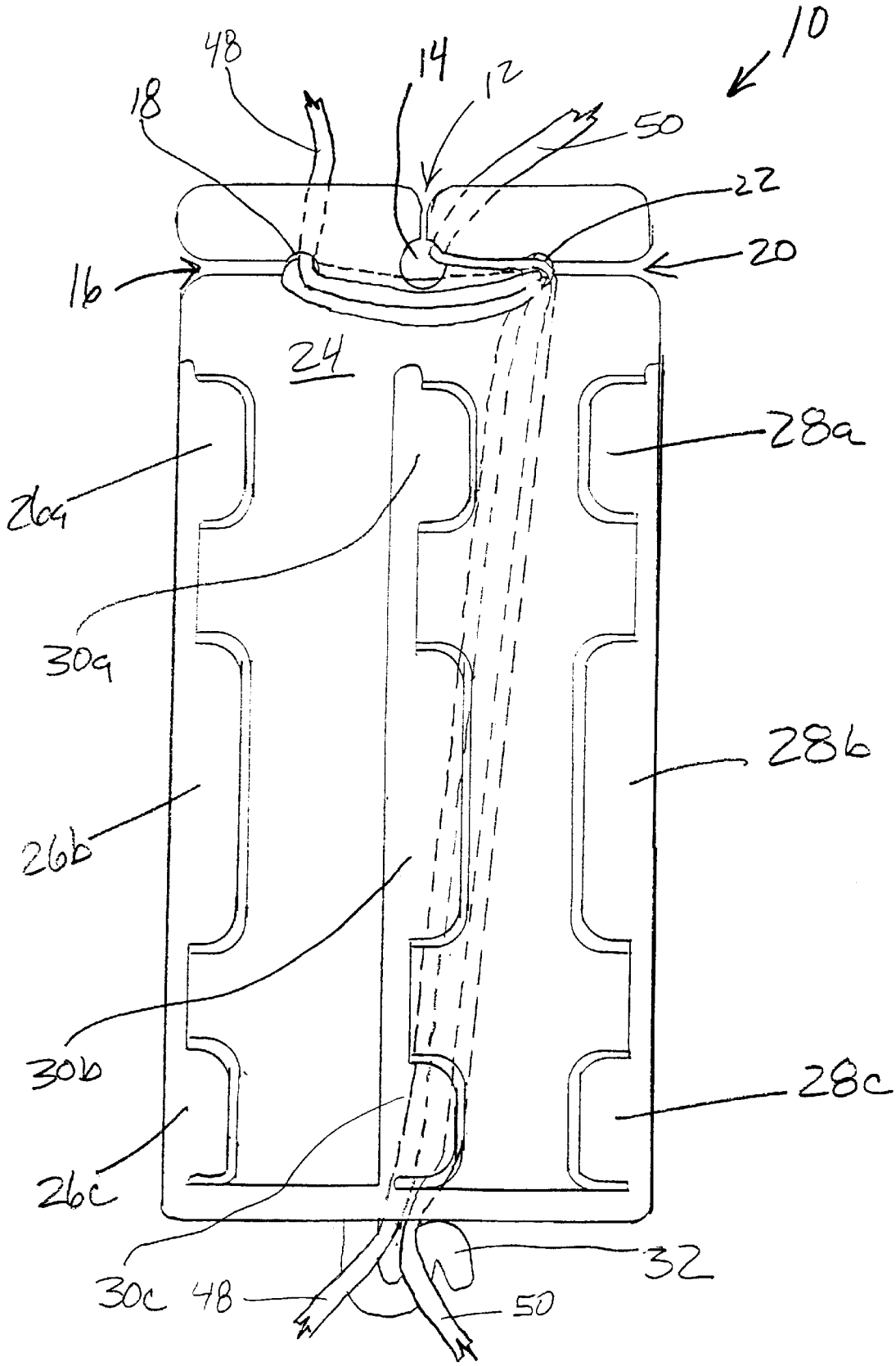

FIG. 1 illustrates a front view of a label holder and closure device 10 with a molded narrower top slot 12, the present invention. The label holder and closure device is comprised of a main body 24 having a centrally located top slot 12 which terminates at a circular aperture 14 and two opposing side slots 16 and 20 which also terminate at circular apertures 18 and 22, all of which are located at the upper end of the body 24, as illustrated. The body 24 of the label holder and closure device 10 incorporates two sets of opposing outer extruded tabs 26*a*–26*c* and 28*a*–28*c* and a middle set of extruded tabs 30*a*–30*c*. The three sets of extruded tabs 26*a*–26*c*, 28*a*–28*c* and 30*a*–30*c* are intended to frictionally hold a label 34 in place. If a small label 34 is used, extruded tabs 28*a*–28*c* and 30*a*–30*c* are used to hold label 34, as illustrated. If a larger label 36 (FIG. 2) is used, extruded tabs 26*a*–26*c* and 28*a*–28*c* are used. There is also provided a retention hook 32 centrally located at the lower end of body 24 of the label holder and closure device 10. The purpose and use of the retention hook 32 will be further described in detail with reference to the mode of operation (FIG. 5). Illustrated in particular is top slot 12 which is molded narrower than the width or thickness of a draw tape 46 (FIG. 5) and narrower than side slots 16 and 20. The narrower top slot 12 prevents the draw tape 46 (FIG. 5) from passing back through the top slot 12, whereupon the label holder and closure device 10 disassociates itself from the draw tape 46 (FIG. 5). It is to be understood that the label holder and closure device 10 can be used with drawstring-type bags and the like.

Figure 2:
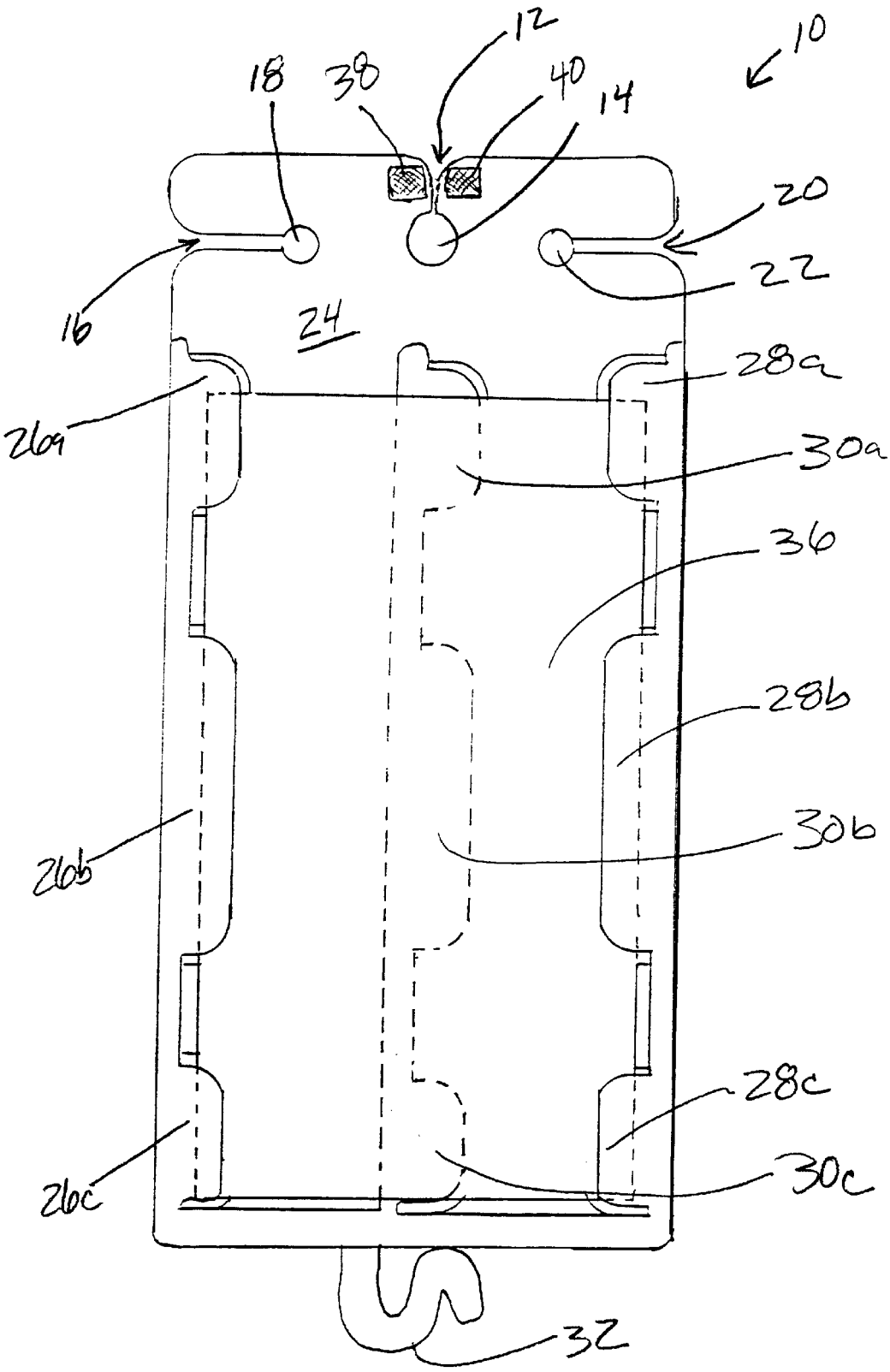
FIG. 2 illustrates a front view of a label holder and closure device with a narrower top slot created by controlled deformations.

FIG. 2 illustrates a front view of a label holder and closure device 10 with a narrower top slot 12 created by controlled deformations 38 and 40, where all numerals correspond to those elements previously described. Illustrated in detail is a narrower top slot 12 which is created by controlled deformations 38 and 40. Controlled deformations 38 and 40 are created by mechanical pressure with or without heat applied to the entrance area of top slot 12 so as to cause the plastic of the label holder and closure device 10 to compress controlled deformations 38 and 40 so as to narrow the entrance of top slot 12 to less than the width or thickness of a draw tape 46 (FIG. 5). Also illustrated is a large label 36 which frictionally engages extruded tabs 26*a*–26*c* and 28*a*–28*c*. Label 36 flexes and passes over extruded tabs 30*a*–30*c*, as illustrated.

Figure 3:
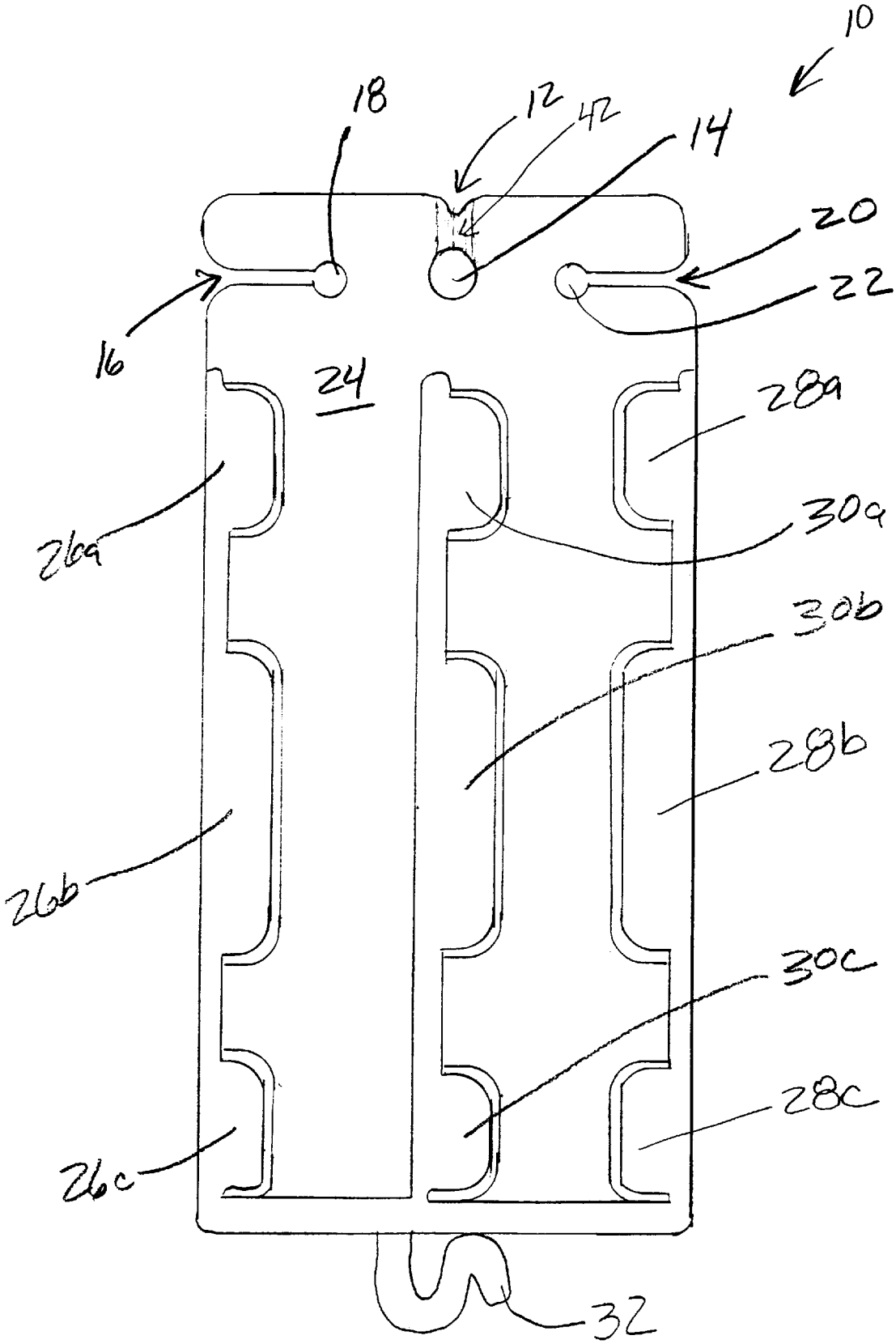
FIG. 3 illustrates a front view of a label holder and closure device with a thin solid webbing molded across the top slot.

FIG. 3, illustrates a front view of a label holder and closure device 10 with a thin solid webbing 42 is molded across the top slot 12, where all numerals correspond to those elements previously described. Illustrated in particular is the solid webbing 42 which is molded across the top slot 12. Either during the manufacturing process or just prior to use, the solid webbing is slit with a scissor, knife or other suitable device and the draw tape 46 (FIG. 5) is slid into aperture 14. The slit in the solid webbing 42 produces an opening less than the width or thickness of draw tape 46 (FIG. 5) which prevents the label holder and closure device 10 from falling off draw tape 46 (FIG. 5). It is to be understood that even though no label is illustrated, the label holder and closure device 10 can accept a large or small label, as previously described and illustrated.

Figure 4:
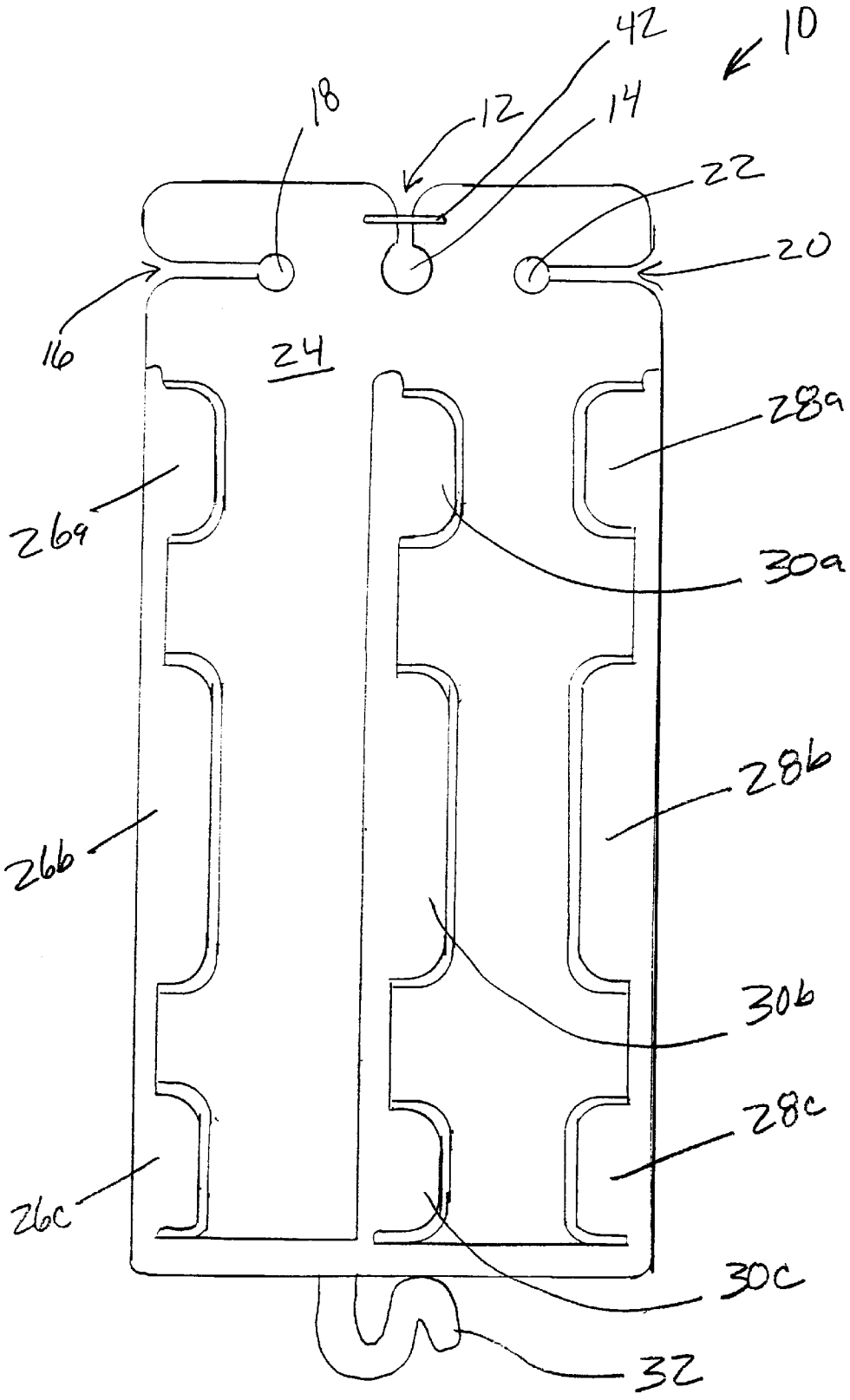
FIG. 4 illustrates a front view of a label holder and closure device with a staple across the top slot; and, FIG. 5 illustrates a front view of a label holder and closure device appropriately securing a draw tape.

FIG. 4 illustrates a front view of a label holder and closure device 10 with a staple 44 across the top slot 12, where all numerals correspond to those elements previously described. Once a draw tape 46 (FIG. 5) is slid into aperture 14 a staple 44 is installed across top slot 12, as illustrated, which secures the label holder and closure device 10 to the draw tape 46 and prevents the label holder and closure device 10 from disassociating itself from draw tape 46 (FIG. 5). Once again, no label is illustrated, but it is to be understood that the label holder and closure device can accept either a large or small label, as previously described and illustrated.

MODE OF OPERATION

FIG. 5 illustrates a front view of a label holder and closure device 10 appropriately securing a draw tape 46, where all numerals correspond to those elements previously described. The process for appropriately installing any of the previously described variations of the label holder and closure device 10 will now be described with special detail as to the path and routing of the draw tape 46. It is to be understood that draw tape 46 is looped through a passage in a cinch-type bag, commonly used by the U.S. Postal Service, and typically creates a loop with no loose ends. The label holder and closure device 10 is applied to the right portion 50 of draw tape 46, once the bag to be used is cinched tight. The right portion 50 of draw tape 46 is slid downwardly through top slot 12 and into circular aperture 14 and the left portion 48 is slid sideways into side slot 16 and then into circular aperture 18. Both the left and right portions 48 and 50, respectively, are then wrapped snugly across the front of the body 24 of the label holder and closure device 10 and slid through side slot 20 and into circular aperture 22. Left portion 48 and right portion 50 are then wrapped snugly around the back side of body 24 and slid through side slot 16 and into circular aperture 18. Once leaving circular aperture 18, left portion 48 and right portion 50 pass over the body 24 and once again slid through side slot 20 into circular aperture 22. At this point, both the left and right portions 48 and 50, respectively, are pulled downwardly along the rear surface of body 24 and are slid into retention hook 32, as illustrated. This configuration appropriately secures the draw tape 46 and keeps the left and right portions 48 and 50 of draw tape 46 tucked behind the extruded tabs 26*a*–26*c*, 28*a*–28*c* and 30*a*–30*c*so the user has an unobstructed view of a label 34 or 36 (FIGS. 1 AND 2).

Various modifications can be made to the present invention without departing from the apparent scope hereof. The spacing of the slots is such to frictionally engage the draw tape. The spacing of the hook is such to frictionally engage the draw tape through the gap. The extruded tabs are spaced so as to engage or even frictionally engage a label

What is claimed is:

1. A process comprising:

a. providing a label holder and closure device for securing a left and a right portion of a draw tape, once a bag to be closed has been cinched tight by the draw tape, the label holder and closure device having a body with a front, a back side, a top slot terminating in a circular aperture, opposed side slots each terminating in a circular aperture, a label portion having extruded tabs on the front, and a retention hook below the label portion, the draw tape having a right portion and a left portion;

b. sliding the right portion of the draw tape downwardly through the top slot and into the circular aperture;

c. sliding the left portion sideways into a side slot of the opposed side slots and then into a circular aperture of the side slots;

d. snugly wrapping both left and right portions, respectively, across the front of the body of the label holder and closure device and sliding through another side slot of the opposed side slots and into the circular aperture of the another side slot;

e. snugly wrapping both left portion and right portion around the back side of the body and sliding through a side slot and into a circular aperture;

f. again snugly wrapping both the right and left portions after once leaving the circular aperture, the left portion and the right portion thereby passing over the body and once again sliding through the first side slot of the opposed side slots into the circular aperture where both the left and right portions, respectively, are pulled downwardly along the rear surface of the body and sliding into the retention hook, thereby securing the draw tape and keeping the left and right portions of the draw tape tucked behind the extruded tabs of the label portion so as to maintain an unobstructed view of the label portion.

2. A label holder and closure device comprising:

a. a body, the body having a top, a bottom, a front side and a back side;

b. a top slot in said body;

c. opposing side slots adjacent said top slot in said body;

d. a retention hook on the bottom of said body; and, e. a label holder portion on the front side of the body, the label holder portion having a plurality of extruded tabs for holding a label.

3. The label holder and closure device of claim 2, wherein the plurality of extruded tabs of the label holder portion includes a first set of extruded tabs and a second set of extruded tabs, the second set of extruded tabs being opposed to the first set, the first set of extruded tabs and the second set of extruded tabs together allowing a label to be frictionally held there between.

4. The label holder and closure device of claim 3, wherein the label holder portion is further includes a third set of extruded tabs, the third set of extruded tabs situated between the first set of extruded tabs and the second set of extruded tabs and being opposed to the first set of extruded tabs and together with the first set of extruded tabs allowing a label to be frictionally held there between.

5. The label holder and closure device of claim 4, wherein a label held between the first set of extruded tabs and the second set of extruded tabs flexes and passes over the third set of extruded tabs.

6. The label holder and closure device of claim 2, wherein the top slot includes a terminal aperture.

7. The label holder and closure device of claim 2, wherein the opposing side slots include terminal apertures.

8. The label holder and closure device of claim 2, wherein the label holder and closure device is formed of plastic.

9. The label holder and closure device of claim 8, wherein the top slot is narrowed by controlled deformations adjacent the slot.

10. The label holder and closure device of claim 9, wherein the controlled deformations result from mechanical pressure.

11. The label holder and closure device of claim 9, wherein the controlled deformations result from heat and mechanical pressure.

12. The label holder and closure device of claim 9, wherein the controlled deformations are adjacent an entrance to the top slot.

13. The label holder and closure device of claim 2, wherein the top slot is characterized by a width less than that of the opposed slots.

14. The label holder and closure device of claim 8, wherein the top slot is formed by a slitting a molded solid webbing.

15. The label holder and closure device of claim 2, further comprising a staple across the top slot.

16. A process for closing and labeling a flexible container having a draw tape, the draw tape having a left portion and a right portion, the process comprising the steps of:

a. providing a label holder and closure device, the device formed of plastic and having a body, a label holder including a plurality of extruded tabs on a front of the body, a rear side, a top aperture, first and second opposed side slots adjacent the top aperture and above the label holder, and a retention hook at the bottom of the body, below the label holder;

b. associating the right portion of the tape with the top aperture;

c. sliding the left portion of the tape in a first side slot of the opposed side slots;

d. snugly wrapping each of the left and right portions across the front, above the label holder, and then sliding the left and right portions in a second of the opposed side slots, thereby associating the left and right portions of the draw tape;

e. snugly wrapping the associated left and right portions, from the second of the opposed side slots, across the backside and then sliding the snugly wrapped associated left and right portions in the first of the opposed side slots;

f. snugly wrapping the associated left and right portions, from the first of the opposed side slots, across the front and then again sliding the left and right portions in the second opposed slide slot; and, g. pulling the associated left and right portions from the second opposed side slot toward the retention hook and sliding into the retention hook, such that the left and right portions of the draw tape are secured together by the device and the label holding portion of the device remains unobstructed.

17. The process of claim 16, wherein left and right portions of the draw tape are part of a loop.

18. The process of claim 17, wherein the top aperture is associated with a top slot and the step of associating the right portion of the draw tape with the device includes sliding the right portion of the draw tape through the top slot to the top aperture.

19. The process of claim 18, wherein the top slot is narrower than the draw string so as to retain the right portion of the draw tape in the top apertura.

20. The process of claim 18, wherein the slot is closed with a staple so as to retain the right portion of the draw tape.

21. The process of claim 16, further comprising the step of placing a label in the label holder.

22. The process of claim 16, wherein the label holder includes a plurality of extruded tabs.

23. The process of claim 22, wherein the plurality of extruded tabs includes a first set of extruded tabs and a second set of extruded tabs opposed to the first set of opposed extruded tabs, providing a label holding space therebetween.

24. The process of claim 23, wherein the plurality of extruded tabs further includes a third set of extruded tabs situated between the first and second set of extruded tabs and opposed to the first set of extruded tabs, providing a smaller label holding space therebetween.

25. The process of claim 23, further comprising the step of inserting a label in the label holding space.

26. The process of claim 24, further comprising inserting a smaller label in the smaller label space.

27. The process of claim 24, further comprising the step of flexing a larger label to pass over the third set of extruded tabs while inserting the label in the label space.

* * * * *